US008147093B2

(12) United States Patent
Hum

(10) Patent No.: US 8,147,093 B2
(45) Date of Patent: Apr. 3, 2012

(54) LIGHT SOURCE HAVING LEDS OF SELECTED SPECTRAL OUTPUT, AND METHOD FOR CONSTRUCTING SAME

(75) Inventor: David Hum, Palo Alto, CA (US)

(73) Assignee: Bridgelux, Livermore, CA (US)

( * ) Notice: Subject to any disclaimer, the term of this patent is extended or adjusted under 35 U.S.C. 154(b) by 0 days.

(21) Appl. No.: 12/815,327

(22) Filed: Jun. 14, 2010

(65) Prior Publication Data

US 2011/0069482 A1 Mar. 24, 2011

(51) Int. Cl.
*F21V 9/00* (2006.01)

(52) U.S. Cl. ..... 362/231; 362/97.3; 362/249.02; 257/89

(58) Field of Classification Search ..... 362/231, 362/97.3, 249.02; 257/89
See application file for complete search history.

(56) References Cited

U.S. PATENT DOCUMENTS 7,318,651 B2 * 1/2008 Chua et al. ..... 362/11
7,478,925 B2 * 1/2009 Hiyama et al. ..... 362/249.02
7,479,660 B2 * 1/2009 Kobilke ..... 257/89
7,677,750 B2 * 3/2010 Jeon et al. ..... 362/97.3
2004/0012959 A1 * 1/2004 Robertson et al. ..... 362/247
2004/0105261 A1 * 6/2004 Ducharme et al. ..... 362/231
2004/0129944 A1 * 7/2004 Chen ..... 257/89
2007/0235639 A1 * 10/2007 Rains, Jr. ..... 250/228
2008/0123021 A1 * 5/2008 Park et al. ..... 349/67
2008/0238335 A1 * 10/2008 Lee et al. ..... 315/294
2008/0316741 A1 * 12/2008 Lee ..... 362/231
2009/0213575 A1 * 8/2009 Bl mel et al. ..... 362/97.3
2010/0165600 A1 * 7/2010 Ku ..... 362/84

* cited by examiner

*Primary Examiner* — Ismael Negron
(74) *Attorney, Agent, or Firm* — Calvin B. Ward

(57) ABSTRACT

A compound light source is characterized by an output spectral measure that lies within a spectral measure design range and an average light intensity per component light source that lies within an output intensity design range. The plurality of component light sources includes light sources whose spectral measure value and output intensity lie outside the corresponding design ranges. The component light sources are chosen from a number of predetermined groups obtained by sorting the component light sources with respect to the spectral measure value and output intensity of each source such that the compound light source has a spectral measure value and output intensity that lies within the corresponding design ranges.

14 Claims, 6 Drawing Sheets

LIGHT SOURCE HAVING LEDS OF SELECTED SPECTRAL OUTPUT, AND METHOD FOR CONSTRUCTING SAME

BACKGROUND OF THE INVENTION

Light-emitting diodes (LEDs) are good candidates to replace incandescent and other light sources. LEDs have higher power to light conversion efficiencies than incandescent lamps and longer lifetimes. In addition, LEDs operate at relatively low voltages, and hence, are better adapted for use in many battery-powered devices. Furthermore, LEDs are point sources, and hence, are better adapted than fluorescent sources for lighting systems in which a point light source that is collimated or focused by an optical system is required.

To compete with incandescent lights, the output spectrum of the LED must be altered to provide a spectrum that is perceived as being "white" by a human observer. In general, LEDs generate light in a small band of wavelengths. Hence, to build a light source that is perceived as being white, light from a monochromatic LED is typically down converted by a phosphor layer to provide light in additional regions of the visual spectrum. The most common form of white LED utilizes a blue-emitting LED and a layer of phosphor that converts part of the blue light into yellow light. The combination of blue and yellow light is perceived by a human observer to be white if the ratio of blue to yellow light is properly chosen.

The color temperature of the white light source depends critically on the ratio of blue light to yellow light in the output of the light source. The amount of yellow light that is produced depends on the peak wavelength of the underlying blue light source. If the wavelength shifts, the fraction of the blue light that is converted to yellow light by the phosphor also shifts, and hence, the perceived color temperature of the light source shifts.

One of the major limitations to mass adoption of LED light sources is the ability to provide constant color and constant flux. At present, there is considerable variation both in the peak wavelength and radiant power of the LEDs. The peak wavelength and total radiant power of LEDs can vary by ±10 nm in peak wavelength and by ±20percent in radiant power. As a result, there is considerable variation in both the color temperature and radiant power of the final white LEDs unless compensating measures are taken. For example, in one solution to this problem, the LED chips are measured and sorted into bins according to the peak wavelength and the output power. A manufacturer then adjusts the manufacturing recipe to match a particular bin.

In another compensating strategy, white sources are combined and regulated in intensity to provide a white source of a predetermined color temperature and intensity. For example, U.S. Pat. No. 7,568,815 describes a scheme in which three white LEDs having different spectra are used to construct a white light source that has a particular color temperature by adjusting the relative intensities of the three white LEDs. While this approach provides a light source in which the manufacturing recipe does not need to vary due to variations in the LEDs, the cost of providing a controller and adjusting the relative outputs of the LEDs significantly increases the cost of the light source. Accordingly, a light source design that does not require a different recipe for each LED bin, while avoiding the cost of providing a controller and adjusting the output of each LED is needed.

SUMMARY OF THE INVENTION

The present invention includes a compound light source constructed from a plurality of component light sources and a method for constructing the same. The compound light source is characterized by an output spectral measure that lies within a spectral measure design range defined by first and second target spectral values and an average light intensity per component light source that lies within an output intensity design range defined by first and second intensity values. The plurality of component light sources includes light sources whose spectral measure and output intensity lie outside the spectral measure design range and outside the output intensity design range. The component light sources are chosen from a number of predetermined groups obtained by sorting the component light sources with respect to the spectral measure and output intensity of each source such that the compound light source has a spectral measure and output intensity that lies within the corresponding design ranges.

DETAILED DESCRIPTION OF THE PREFERRED EMBODIMENTS OF THE INVENTION

The present invention is based on the observation that many LED-based light sources of interest must be constructed from a plurality of LED dies, since the light output of a single die is insufficient for these applications. By sorting the dies into a small number of groups, and combining dies from those groups, a light source whose variation in intensity and center wavelength is less than the spread encountered in the dies can be achieved.

Figure 1:
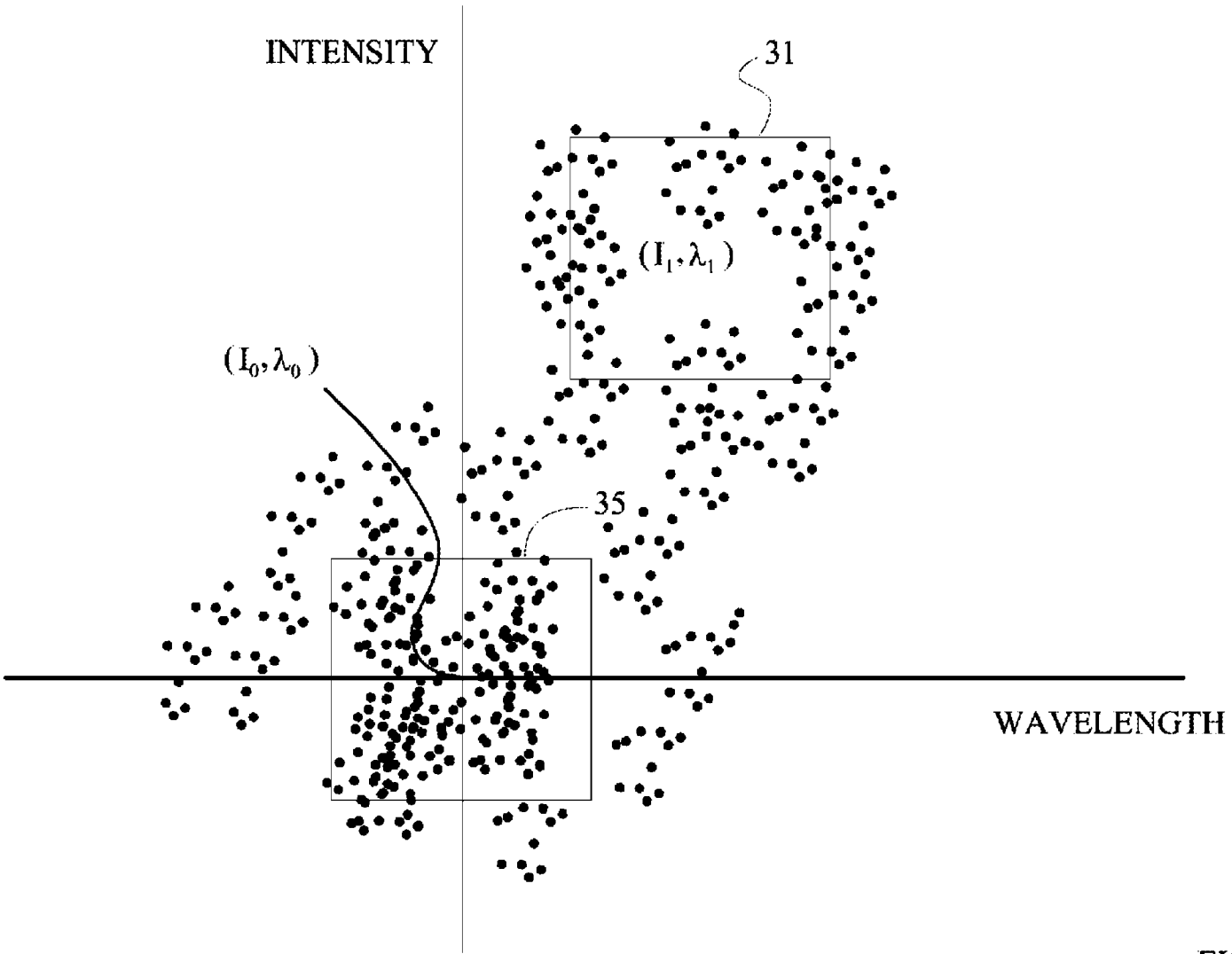
FIG. 1 is a scatter plot illustrating the spread in yield as a function of center wavelength and light intensity for a collection of LED dies fabricated on a number of different wafers.

Refer now to FIG. 1, which is a scatter plot illustrating the spread in yield as a function of center wavelength and light intensity for a collection of LED dies fabricated on a number of different wafers. To simplify the drawing "dots" representing the dies have been omitted from portions of the drawing. In general, the goal of the fabrication process is to provide dies having the same center wavelength, $\lambda_0$, and intensity, $I_0$, at a predetermined operating current. The target center wavelength and intensity are at the origin of the scatter plot. There is some region around the origin, indicated by region 35, in which the variations in the dies are acceptable in that a light source constructed from a plurality of dies from region 35 will be sufficiently close in color and intensity to another light source constructed from the same number of dies from this region. Dies that lie outside of region 35 will be referred to as outlying dies.

The acceptable variation from light source to light source depends on the particular application. If, for example, the two light sources are viewed simultaneously by an observer and are close to one another, the degree of variation that can be tolerated will be less than the degree of variation that can be tolerated if the light sources are separated from one another. However, for many applications, region 35 is sufficiently small that there are a significant number of dies that lie outside this region. If these dies are not utilized, a significant reduction in yield occurs which leads to increased cost for the usable dies.

One solution to utilizing the outlying dies is to "bin" the dies lying outside region 35 into a groups of dies whose characteristics are sufficiently similar that each group of dies can be viewed as being a different type of LED characterized by a center wavelength and average intensity that can be used to construct light sources using a different light source design. For example, the dies in region 31 could be viewed as different type of die having an average peak wavelength of $\lambda_1$, and intensity, $I_1$.

Unfortunately, this solution requires that the party designing and constructing light sources must have different designs for a particular light source so that the light source can be constructed from dies from the group corresponding to region 31 or from the group corresponding to region 35. If the center wavelengths differ by too great an amount, this may not be possible. Furthermore, even when this approach is possible, the added cost to the light source manufacturer presents problems.

Figure 2:
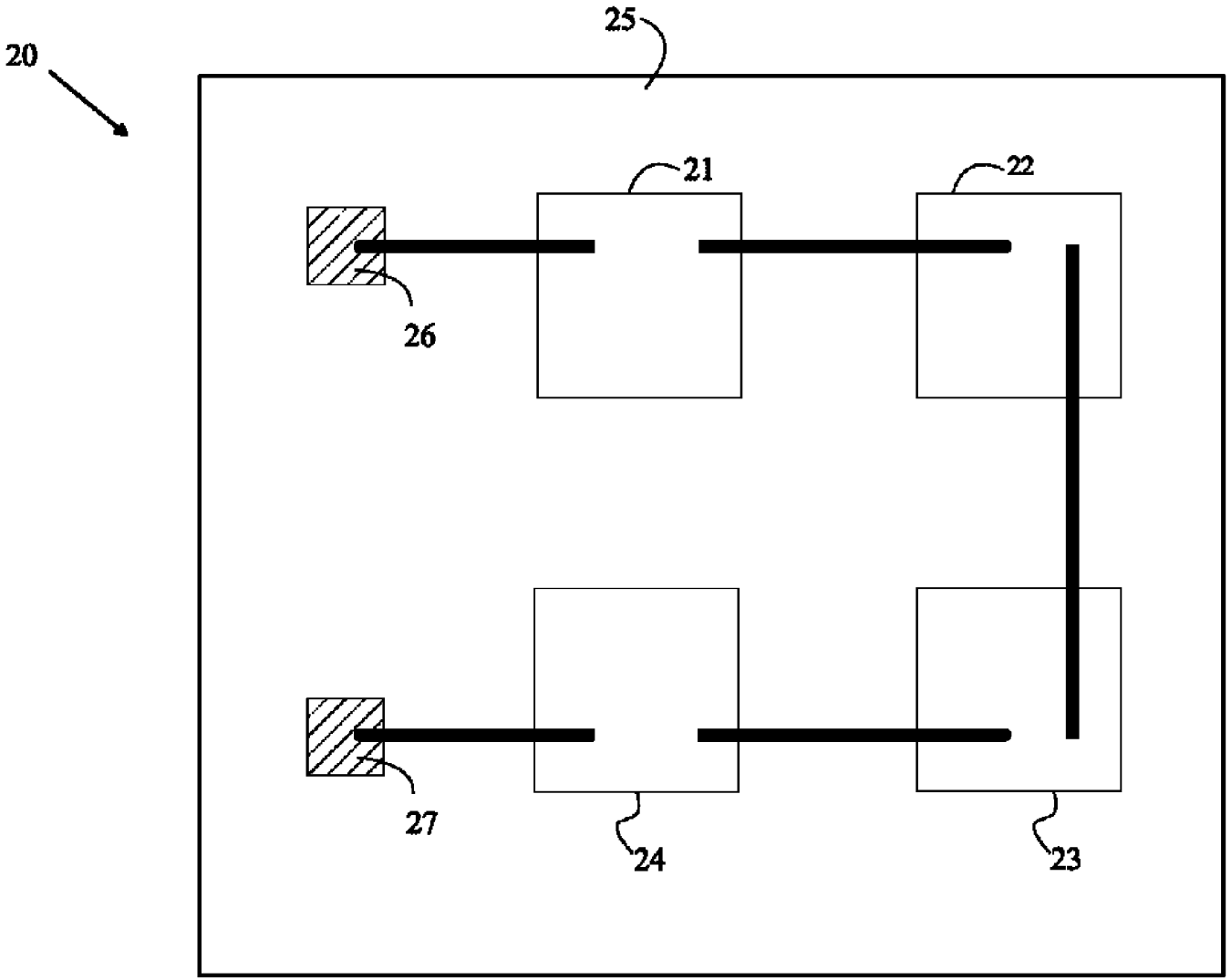
FIG. 2 illustrates one embodiment of a light source according to the present invention.

Refer now to FIG. 2, which illustrates one embodiment of a light source according to the present invention. Light source 20 includes four LED dies shown at 21-24 that are mounted on a substrate 25. Dies 21-24 are connected in series and are powered from pads 26 and 27. The dies are selected such that, on average, light source 20 will emit light at a wavelength closer to a predetermined design wavelength and target light output than a light source constructed from a random selection of four dies.

Figure 3:
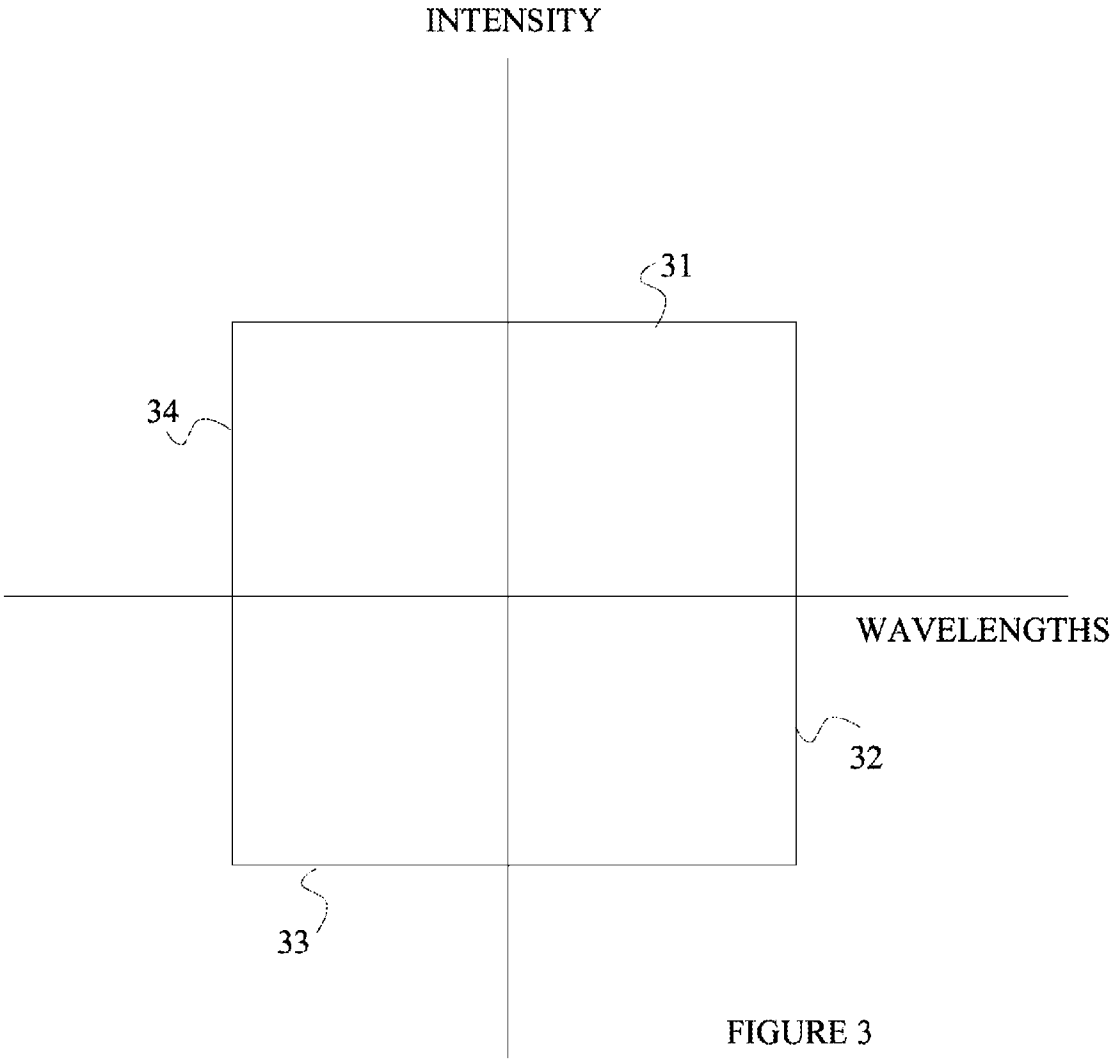
FIG. 3 illustrates the groups in question

In one aspect of the invention, the dies are sorted into four groups depending on each die's performance when a predetermined current is passed through the die. Refer now to FIG. 3, which illustrates the groups in question. The group 32 consists of dies that emit light having a center wavelength that is greater than the target wavelength and an intensity that is below the target intensity. The group 33 consists of dies that emit light having a center wavelength that is less than the target wavelength and an intensity that is less than the target intensity. The group 34 consists of dies that emit light at an intensity that is above the target intensity and a center wavelength that is below the target wavelength. The group 31 consists of dies that emit light at a target intensity that is above the target intensity and a center wavelength that is greater than the target wavelength.

Light source 20 includes one die from each group. Since the dies are connected in series, the current through each die is the same and is controlled by a single power source. For each die that emits at an intensity that is greater than the target intensity, there is a die that emits at an intensity that is less than the target intensity. Hence, the combined light output of the dies has an intensity that is closer to the design intensity than a random selection of four dies.

Similarly, for each die that emits at a wavelength that is greater than the target wavelength, there is a die that emits at a wavelength that is less than the target wavelength. Hence, the output spectrum will be somewhat broadened and will have a center frequency that is closer to the design center frequency. In applications that require a source with a good color rendering spectrum, the broader output spectrum provides improved performance.

Figure 4:
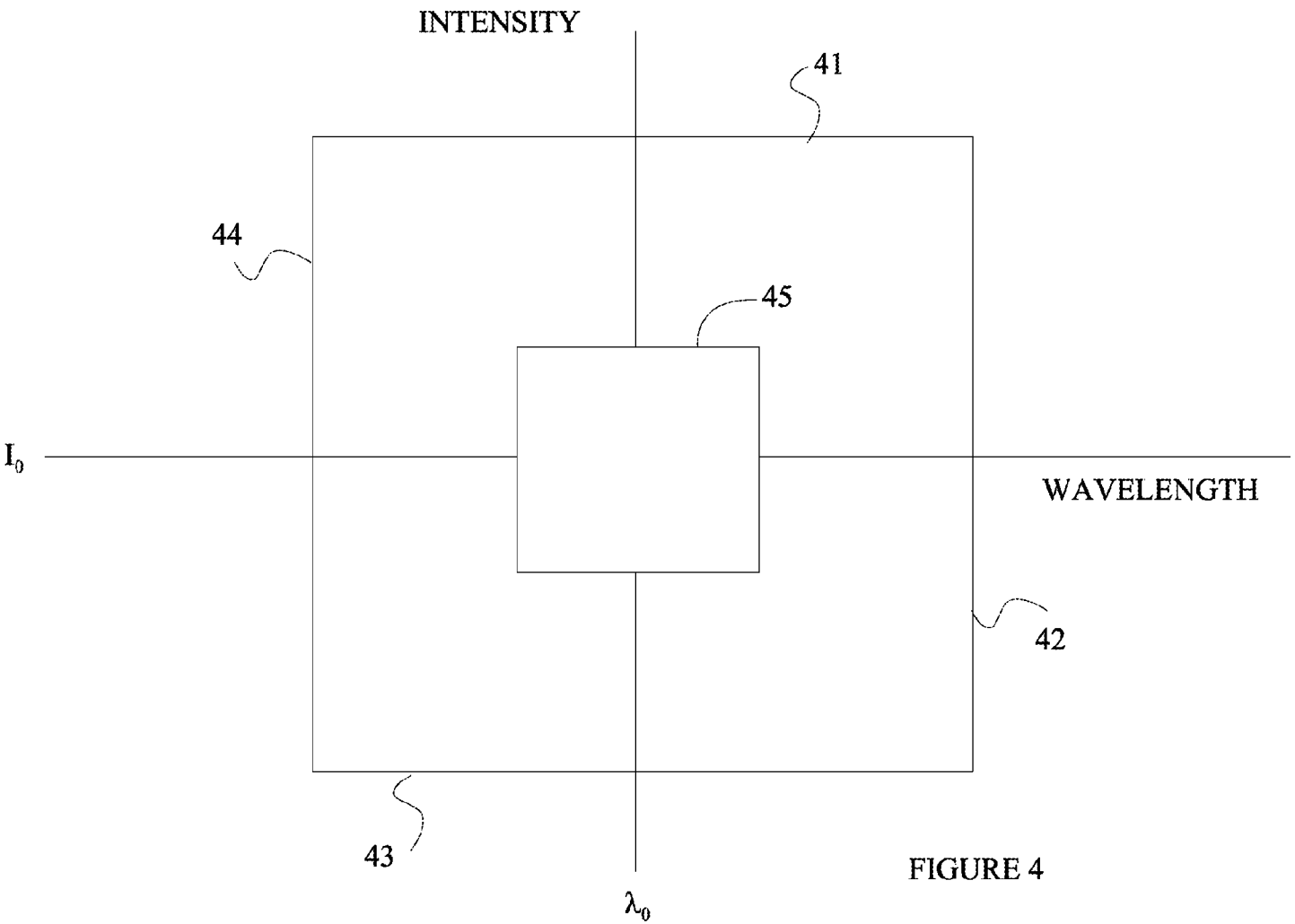
FIG. 4 illustrates the sorting of the dies into five groups.

The embodiments discussed above assume that the final light source is to have an output intensity that is a multiple of 4 times the die target intensity. In some applications, this restriction can pose problems. This restriction can be overcome by sorting the dies into five groups. Refer now to FIG. 4, which illustrates the sorting of the dies into five groups. The fifth group, shown at 45 is centered on the target wavelength and intensity values and consists of all of the dies that are already within the target design specification. The remaining dies are outliers that are sorted into the four groups shown at 41-44. A light source can be constructed from a combination of dies from the various groups.

In this aspect of the invention, four dies are chosen from groups 41-44, one per group. One or more additional dies from group 45 are added to each of the light sources to adjust the intensity to the desired intensity. For example, if a light source having a nominal intensity of 5 times that of a single die is required, one additional die from group 45 is added to each light source and placed in series with the dies from the first four groups. Similarly, if a nominal intensity of 6 times that of a single die is required, two additional group 45 dies are added, and so on. Since the group 45 dies are already within the design specification, the additional dies will not cause the light source to be out of the design specification. In fact, the additional dies should further reduce the spread in center wavelength and intensity values.

It should also be noted that the average intensity per die of a light source consisting of one die from group 41 and one die from group 43 will be within region 45. Similarly, the average intensity per die of a light source constructed from one die from group 42 and one die from group 44 will be within region 45. Hence, the present invention can be utilized to provide a light source that has an intensity that is a multiple of 2 times the design intensity.

In addition, a light source having an intensity that is a multiple of 6 times the $I_0$ can also be constructed by utilizing one die each from groups 41-44, or groups 31-34 discussed above, plus two additional dies chosen from either groups 41 and 43 or from groups 42 and 44.

Figure 5:
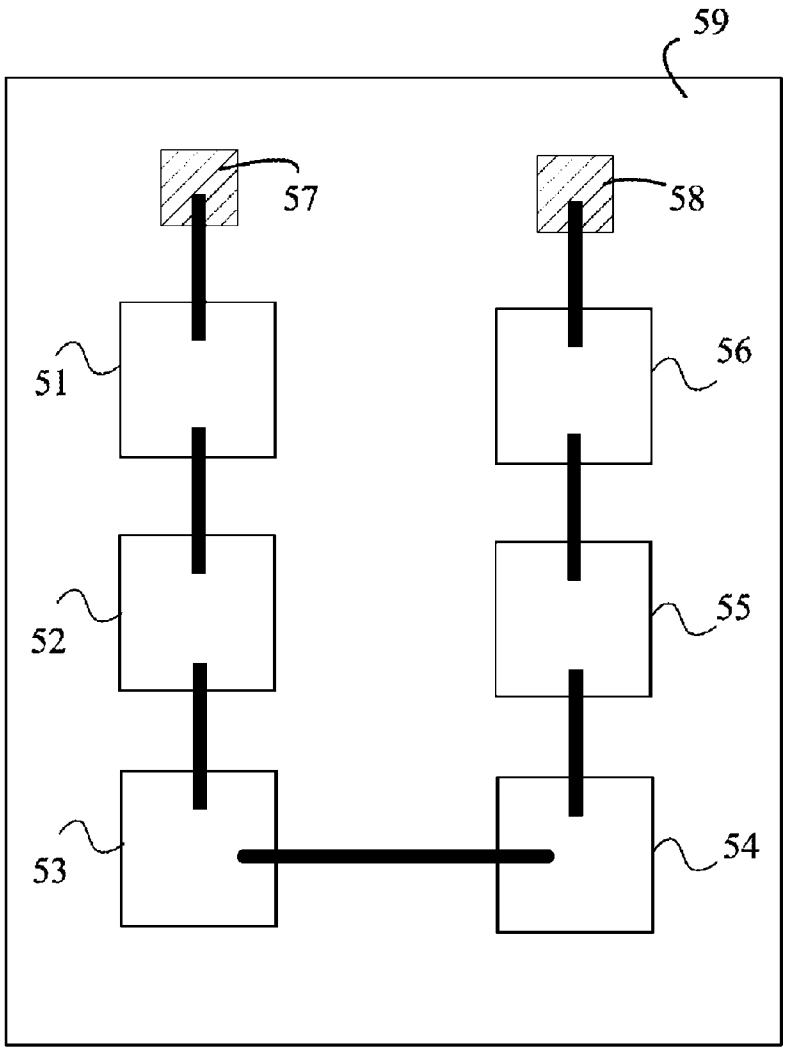
FIG. 5 illustrates a light source having six dies.

Refer now to FIG. 5, which illustrates a light source having six dies. The dies are mounted on a substrate 59 and connected in series. The light source is powered via pads 57 and 58. In this example, dies 52 and 55 are selected from region 45 shown in FIG. 4, and dies 51, 53, 54, and 56 are selected from regions 41-44, respectively.

The above-described embodiments have utilized dies with single LEDs that emit light in a relatively narrow band of wavelengths. However, the principles of the present invention can be applied to light sources constructed from other forms of component light sources. For the purposes of this discussion, a component light source can be viewed as a source that is characterized by an output spectrum that is characterized by some spectral measurement that depends on the wavelengths of light emitted and by an output light intensity that is generated under a predetermined set of driving conditions.

For example, phosphor-converted LEDs are constructed from an LED that is covered by a layer of phosphor that converts part of the light emitted by the LED to light having a different spectrum. Most "white LEDs" are constructed in this manner by using a die having a blue LED that is covered by a yellow phosphor. The light emitted by this type of light source is perceived to be white by a human observer. The light that is emitted can be characterized by a color temperature which relates the output spectrum to the spectrum emitted by a black body operating at that temperature. The color temperature of the light emitted from a phosphor converted white LED depends on the ratio of the intensities of the phosphor converted light to the blue light that remains in the final spectrum. A number of manufacturing factors can introduce variations in the color temperature from die to die. These factors also influence the variation in intensity from die to die. Hence, a manufacturing facility that produces white LEDs is typically characterized by a significant variation in both the color temperature and light intensity in the final white LEDs.

The present invention can be used to combine the component light sources into larger sources that have significantly less variability, and hence, improve the yield of the manufacturing process. In the case of white LEDs, the dies are sorted into groups in a manner analogous to that described above into four or five groups. Each die is characterized by its color temperature and the intensity of light generated when a predetermined current is used to power the die. The groups are defined with respect to a target color temperature and output light intensity.

Figure 6:
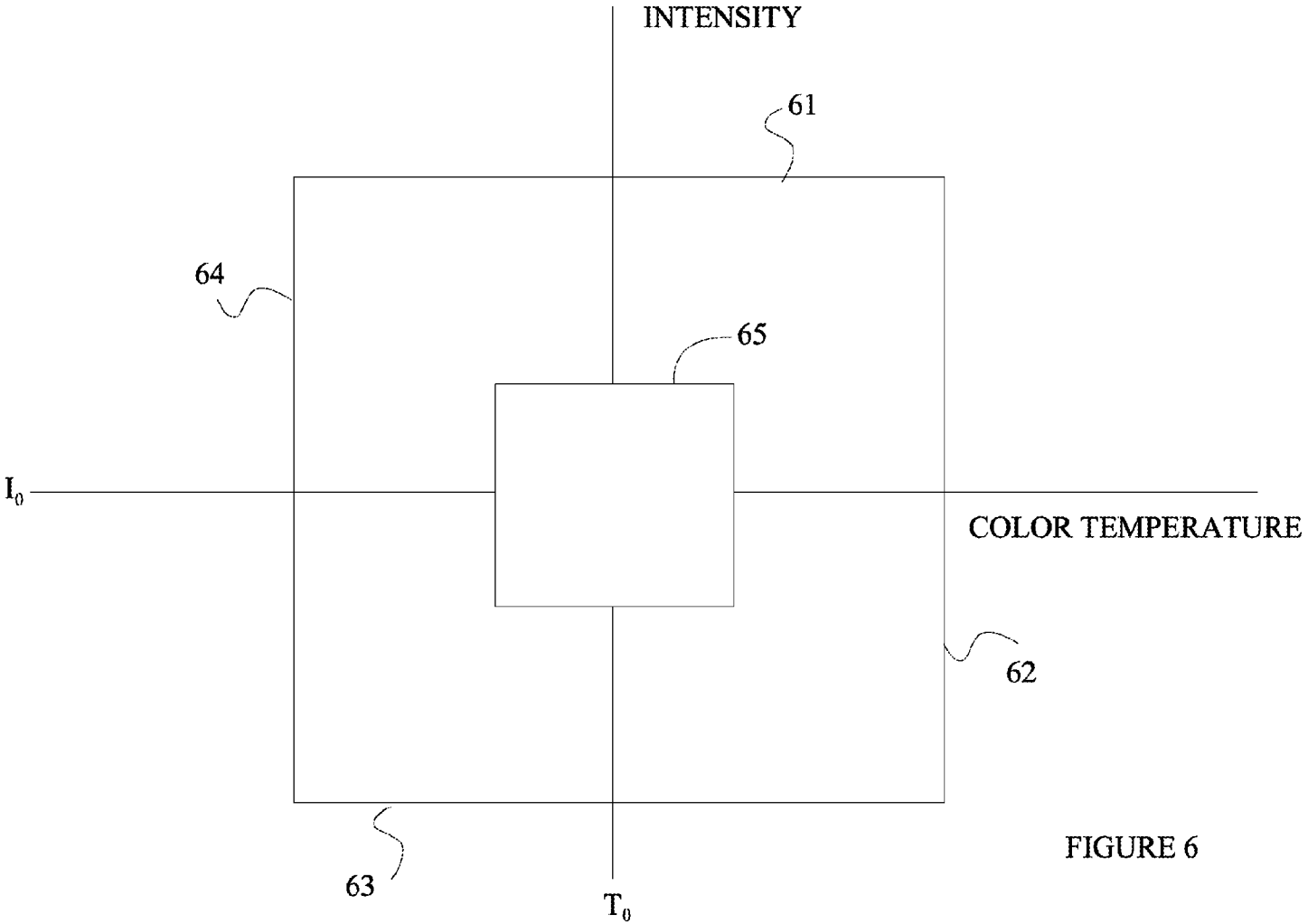
FIG. 6 illustrates the groups of dies in the case in which the dies are sorted into five groups based on color temperature and intensity.

Refer now to FIG. 6, which illustrates the groups of dies in the case in which the dies are sorted into five groups based on color temperature and intensity. The first group shown at 65 consists of the dies that have a color temperature and intensity that are within acceptable variations with respect to the design color temperature $T_0$ and design intensity $I_0$. Groups 61-64 include the dies outside of group 65. Group 61 consists of dies that have color temperatures greater than $T_0$ and intensities greater than $I_0$. Group 62 consists of dies that have color temperatures greater than $T_0$ and intensities less than $I_0$. Group 64 consists of dies that have color temperatures less than $T_0$ and intensities greater than $I_0$. Group 63 consists of dies that have color temperatures less than $T_0$ and intensities that are less than $I_0$.

In the more general case of a phosphor converted LED that is not necessarily a "white" LED, the spectral measure can be defined with respect to the output light intensity at two or more wavelengths. For example, the ratio of the output intensity within a predetermined blue band of wavelengths to the output intensity with a predetermined yellow or green band of wavelengths could be utilized. Other spectral measures involving the intensities at additional wavelengths could also be utilized.

A light source according to one embodiment of the present invention has at least two dies selected from groups 61-64. One die could be selected from group 61 and the other from group 63, or one die could be selected from group 62 and the other from group 64. In another embodiment, the light source has one die selected from each of groups 61-64. In yet another embodiment, one of these embodiments includes one or more dies from group 65.

The above-described embodiments of the present invention are directed to compound light sources that are constructed from a plurality of component light sources consisting of single semiconductor dies. However, the embodiments of the present invention in which the component light sources are themselves compound light sources constructed from a plurality of semiconductor dies can also be constructed. The compound light sources can be compound light according to the present invention as described above or other light sources that are characterized by variations in two parameters.

The above-described embodiments of the present invention have been provided to illustrate various aspects of the invention. However, it is to be understood that different aspects of the present invention that are shown in different specific embodiments can be combined to provide other embodiments of the present invention. In addition, various modifications to the present invention will become apparent from the foregoing description and accompanying drawings. Accordingly, the present invention is to be limited solely by the scope of the following claims.

What is claimed is:

1. A compound light source comprising a plurality of component light sources, said compound light source being characterized by an output spectral measure and an average light intensity per component light source when each component light source is driven with a predetermined design current that is the same for each of said component light sources, said output spectral measure of said compound light source having a value within a spectral measure design range defined by first and second target spectral values, and said average light intensity per component light source being within an output intensity design range defined by first and second intensity values, said compound light source being unsatisfactory for its intended use if said output spectral measure is outside said spectral measure design range or said average light intensity per component light source is outside said output design range, said plurality of component light sources comprising:

first and second component light sources, each component light source being characterized by said spectral measure and by an output light intensity when driven with said predetermined design current, said spectral measure of one of said first and second component light sources having a value outside of said spectral measure design range or said output intensity of one of said first and second component light sources being outside of said output intensity design range when said component light sources are driven with said predetermined current, wherein said first and second component light sources generate a combined light output that is characterized by said spectral measure and an average light intensity per component light source when driven with said predetermined current, said spectral measure of said combined light output having a value within said spectral measure design range and said average light intensity per component light source being within said output intensity design range when said component light sources are driven with said predetermined current.

2. The compound light source of claim 1 wherein said spectral measure of both of said first and second component light sources is outside of said spectral measure design range and wherein said output light intensity of both of said first and second component light sources is outside of said output intensity design range when said first and second component light sources are driven with said predetermined current.

3. The compound light source of claim 1 wherein said output light intensity of said first component light source is greater than said second intensity value and said output light intensity of said second component light source is less than said first intensity value, said first intensity value being less than said second intensity value, and wherein said spectral measure of said first component light source has a value greater than said second target spectral value and said spectral measure of said second component light source has a value less than said first target spectral value, said first target spectral value being less than said second target spectral value when said component light sources are driven at said predetermined current.

4. The compound light source of claim 1 wherein said output light intensity of said first component light source is greater than second intensity value and said output light intensity of said second component light source is less than said first intensity value, said first intensity value being less than said second intensity value, and wherein said spectral measure of said first component light source has a value less than said first target spectral value and said spectral measure of said second component light source has a value greater than said second target spectral value, said first target spectral value being less than said second target spectral value when said component light sources are driven at said predetermined current.

5. The compound light source of claim 1 further comprising a third component light source characterized by said spectral measure and by an output light intensity, said spectral measure of said third component light source having a value within said spectral measure design range and said output light intensity of said third component light source being within said output intensity design range when said component light sources are driven at said predetermined current.

6. The compound light source of claim 1 wherein said first and second component light sources comprise LEDs characterized by an output spectrum characterized by a center wavelength and wherein said spectral measure is a function of said center wavelength.

7. The compound light source of claim 1 wherein said first and second component light sources are connected in series.

8. The compound light source of claim 1 wherein said first and second component light sources comprise phosphor-converted LEDs.

9. The compound light source of claim 8 wherein said phosphor converted LEDs are characterized by a color temperature and wherein said spectral measure is related to said color temperature.

10. The compound light source of claim 8 wherein said spectral measure is determined by an output light intensity measured at two different wavelengths.

11. A method for constructing a compound light source comprising a plurality of component light sources, said compound light source being characterized by an output spectral measure having a value within a spectral measure design range defined by first and second target spectral values and an average light intensity per component light source when each component light source is driven with a predetermined design current that is the same for each of said component light sources, said average light intensity per component light source being within an output intensity design range defined by first and second intensity values, said compound light source being unsatisfactory for its intended use if said output spectral measure is outside said spectral measure design range or said average light intensity per component light source is outside said output design range, said method comprising:

selecting first and second component light sources, each component light source being characterized by a spectral measure and by an output intensity, said spectral measure of one of said first and second component light sources having a value outside of said spectral measure design range or said output intensity of one of said first and second component light sources being outside of said output intensity design range, wherein said first and second component light sources are characterized by a combined spectral measure having a value within said spectral measure design range, and wherein said first and second component light sources are characterized by an average output intensity that lies with said output intensity design range;

mounting said first and second light sources on a substrate; and connecting said first and second component light source together to form said compound light source.

12. The method of claim 11 wherein said selecting comprises sorting a plurality of component light sources into first and second groups, said first group comprising component light sources having said output intensity greater than second intensity value and said spectral measure having a value greater than said second target spectral value and said second group comprising component light sources having said output intensity less than said first intensity value and said spectral measure having a value less than said first target spectral value, said first target spectral value being less than said second target spectral value and said first intensity value being less than said second intensity value.

13. The method of claim 12 wherein said selecting further comprises sorting said plurality of component light sources into third and fourth groups, said third group comprising component light sources having said output intensity less than said first intensity value and said spectral measure having a value greater than said second target spectral value and said fourth group comprising component light sources having said output intensity greater than said second intensity value and said spectral measure having a value less than said first target spectral value.

14. The method of claim 13 wherein said selecting further comprises sorting said plurality of component light sources into a fifth group comprising component light sources having said spectral measure having a value within said spectral measure design range and said output intensity within said output intensity design range.

* * * * *